United States Patent [19]

Vandegriff

[11] 3,974,603

[45] Aug. 17, 1976

[54] CONCRETE WALL BRACING METHOD AND APPARATUS

[75] Inventor: Richard K. Vandegriff, Noblesville, Ind.

[73] Assignee: Vantage Construction Company Inc., Noblesville, Ind.

[22] Filed: Jan. 20, 1975

[21] Appl. No.: 542,207

Related U.S. Application Data

[63] Continuation of Ser. No. 383,512, July 30, 1973, abandoned.

[52] U.S. Cl. ..... 52/166; 52/701; 52/39

[51] Int. Cl.[2] ..... E04B 1/41

[58] Field of Search ..... 61/39, 49; 52/169, 699, 52/701, 702–707

[56] References Cited

UNITED STATES PATENTS

| | | | |
|---|---|---|---|
| 913,875 | 3/1909 | Cleverdon | 52/704 |
| 1,831,153 | 10/1931 | Williams | 249/92 |
| 3,430,408 | 3/1969 | Dean | 52/699 |
| 3,715,851 | 2/1973 | Bennett | 52/707 |

FOREIGN PATENTS OR APPLICATIONS

| | | | |
|---|---|---|---|
| 501,092 | 2/1951 | Belgium | 52/707 |
| 307,657 | 1/1969 | Sweden | 52/701 |

*Primary Examiner*—John E. Murtagh
*Attorney, Agent, or Firm*—Woodard, Weikart, Emhardt & Naughton

[57] ABSTRACT

For a poured concrete basement wall, horizontally spaced rectangular plates are secured to the inner face of the outer wall form in parallel spaced relationship thereto. The inner wall form is then space from the inner face of the plates. Temporary fasteners are inserted through the outer wall form and secured to the plates and shielded from concrete which is then poured into the space between the forms. After setting, the fasteners are removed, the forms removed, and long rods having L-shaped ends remote from the wall are disposed in trenches directed outwardly from the wall, the inner ends being secured to the plates replacing the fasteners. The L-shaped ends are set in concrete poured in the ground and serve as anchors. The rods, anchors, and trenches are then covered up with backfill against the wall.

4 Claims, 6 Drawing Figures

CONCRETE WALL BRACING METHOD AND APPARATUS

This is a continuation, of application Ser. No. 383,512 filed July 30, 1973, now abandoned.

BACKGROUND OF THE INVENTION

1. Field of the Invention

This invention relates generally to building construction, and more particularly to bracing for concrete walls below grade.

2. Description of the Prior Art

Typically basement wall construction of many residences involves the use of a built-up construction of concrete blocks, resting upon a poured concrete footing. However, there are advantages to, and increasing interest in, making the entire basement wall of poured concrete instead of the conventional block construction.

It is typical practice to brace basement walls from the inside by using many timbers. The purpose is to avoid inward collapse of the walls during backfilling of the excavation around the outside of the wall. Very often the builder will also prefer to complete framing and roofing of the building, and thereby apply a substantial vertical load on the walls, prior to backfilling, in order to help avoid any inward movement of the wall during the backfilling. Nevertheless, it would sometimes be advantageous to backfill before framing the building. Also, considerable savings in terms of labor and materials may be achieved if all of the timber bracing which is currently employed in basement wall construction, could be omitted. The present invention is intended to provide a suitable answer to the need, at least for poured concrete walls.

Although there are some patents known to me as a result of preliminary searching, and they deal with bracing or anchoring of walls or excavations, none of them seems desirable or particularly useful for residential construction of the type with which my invention is primarily concerned. These patents are as follows:

3,226,935 Schneller Jan. 4, 1966
3,243,963 Schnabel, Jr. Apr. 5, 1966
3,299,644 White Jan. 24, 1967
3,507,121 Morfeldt Apr. 21, 1970

It should be understood, of course, that my invention is applicable to construction of buildings other than residences.

SUMMARY OF THE INVENTION

Described briefly, according to a typical example of the method of my invention, the wall form for the outside surface of the basement wall is erected in the basement excavation. Horizontally spaced plates are secured to the inner face of the outside wall form, the plates being preferably at least slightly spaced inwardly from the form. Then the inner wall form is installed and spaced inwardly from the plates. Temporary fasteners are installed through the outer forms into the plates. Then concrete or some other wall construction material which is settable in time, is poured or otherwise deposited in the space between the forms. After setting of the material, the temporary fasteners and wall forms are removed. Either then, or prior to that time, trenches are provided in the earth outside the wall in a direction generally perpendicular thereto. Long anchor rods are then inserted into the plates in place of the previously removed fasteners, these rods being disposed in the trenches. The outer ends of the rods have offset means therein which are then set in concrete or other settable material poured into pockets or cavities in the ground at the outer ends of the rods to anchor them into the ground. Then the pockets, rods, trenches and excavations around the outside walls can be filled with backfill material. The plates preferably have spacers on at least the outer face thereof and a threaded fastener secured to the plate. A tubular cup is on the inner face of each plate, and the cups and spacers shield the temporary fasteners from the wall construction material while the material is in its flowable condition.

DESCRIPTION OF THE PREFERRED EMBODIMENT

As shown on the drawings, a typical embodiment of the invention employs a steel plate 11 having a nut or other internally threaded fastener 12 affixed to the inner face thereof, as by welding, for example. A cylindrical, closed-ended tube 13 is welded on the inner face, and a cylindrical, open-ended spacer tube 14 is welded on the outer face.

Figure 1:
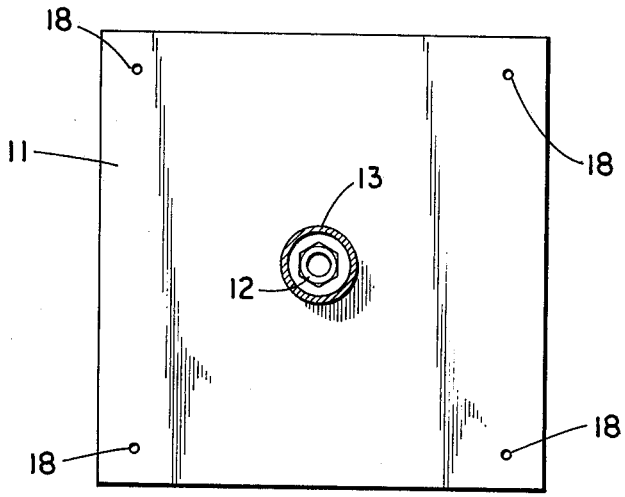
FIG. 1 is a plate of the type typically embedded in a wall according to a typical embodiment of this invention, the plate being viewed in the direction to which it presents its largest bearing area, this being the horizontal direction when the plate is disposed vertically in a wall.
Figures 2A, 2B, 2C:
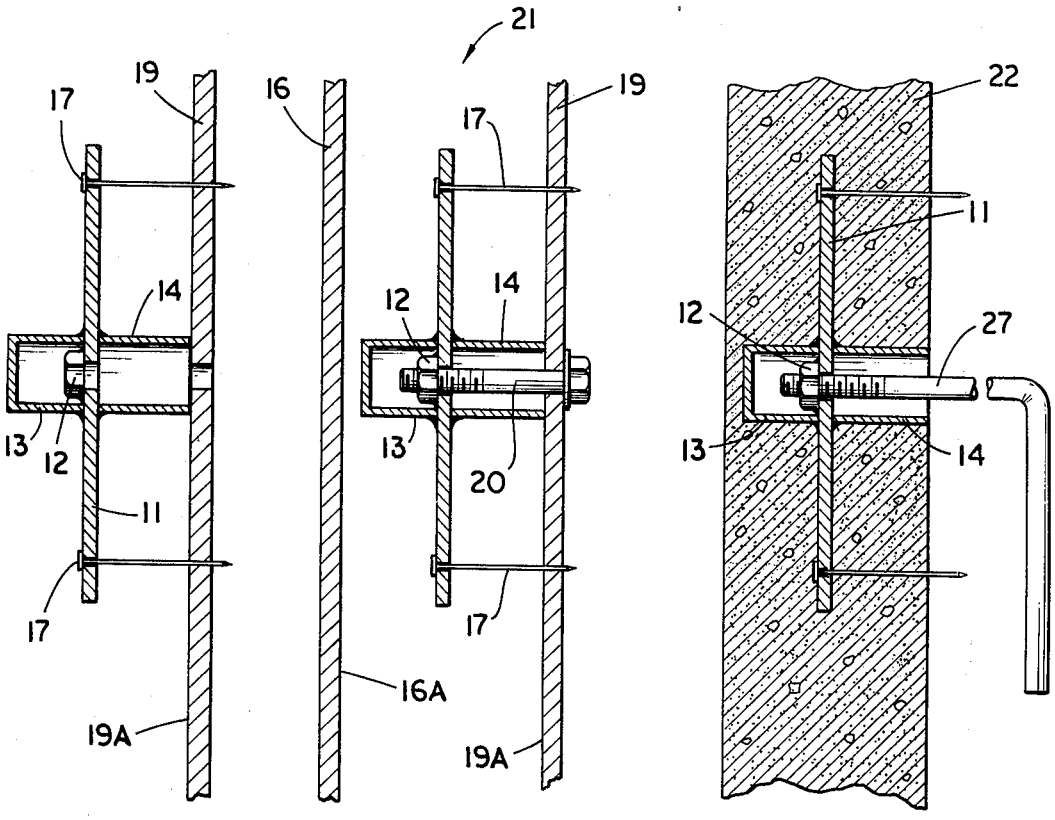
FIG. 2*a* is a fragmentary section through the outside wall form for a basement wall, the section being taken on a vertical plane containing the center line of the fastener nut on the plate of FIG. 1 as it is fastened to the outside wall form.
FIG. 2*b* is a view like FIG. 2*a* but showing the inner wall form installed and a temporary fastener bolt secured in the fastener nut.
FIG. 2*c* is a view similar to FIGS. 2*a* and 2*b*, but showing the wall forms removed, the temporary fastener bolt removed, and the permanent anchor rod installed in its place, the anchor rod being shown with a long portion thereof deleted to conserve space in the drawing.

When the form 19 for locating the outside face of the basement wall has been positioned in place in the basement excavation, or prior to placement in the excavation, plates 11 are nailed to the inside face of the outside wall form at horizontally spaced points thereon by means of nails 17 extending through apertures in the four corners of the plate as at 18 in FIG. 1. The spacer tube 14 holds a spaced relation between the plate 11 and the inner face 19A of the form 19.

Then the inner form 16 is installed and typically spaced from the outer form by conventional spacer means to provide the desired wall thickness. Then a screw or bolt or other temporary fastener 20 is installed through a hole in the outer form and is threadedly received in the nut 12. The screw or bolt 20 extends through the spacer tube 14 and is shielded from concrete as it is poured in the space 21 between the forms and allowed to set. The screw keeps the concrete from running into the threads in the nut 12. Of course the tubes 13 and 14 provide the first line of protection against this happening.

Prior to the steps described above, or concurrently therewith, or subsequent thereto, according to the convenience of the builder, trenches 23 may be dug extending outwardly from the wall in a direction generally perpendicular thereto and in registry with each of the locations at which one of the plates 11 will be embedded in the wall. At the outer end of such trenches a pocket or cavity is provided at 26.

Figure 3:
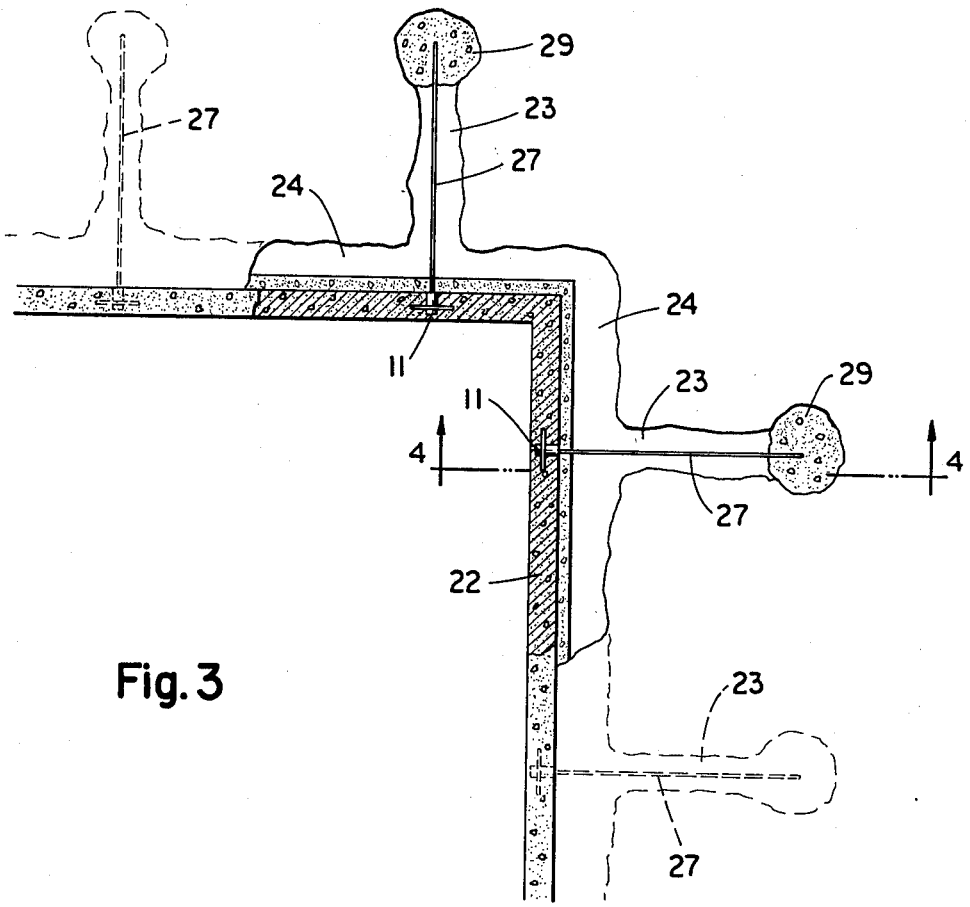
FIG. 3 is a plan view of a poured basement wall at a corner of the basement, with a portion being illustrated in section to show the retainer plates embedded in the wall, and the anchor rods extending therefrom and embedded in anchor blocks poured in pockets or cavities in the ground at the end of trenches and remote from the wall.
Figure 4:
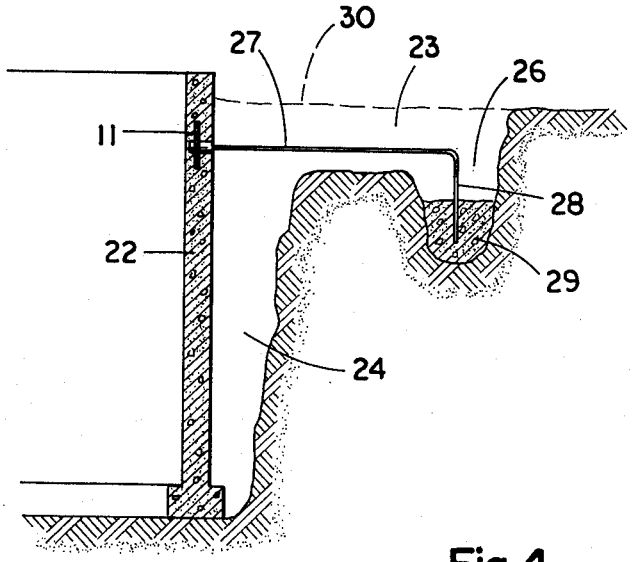
FIG. 4 is a section taken at line 4—4 in FIG. 3 and viewed in the direction of the arrows.

Once the concrete has set, the wall 22 then contains a number of horizontally spaced plates 11 embedded therein, and four of them are shown in FIG. 3, for example. Then the temporary fastener bolts 20 are removed and the inner and outer forms 16 and 19 are removed. The outer ends of the nails 17 can be broken or cut off, or mashed down against the outside wall surface. Then rods 27 are threaded into the nuts 12 in place of the removed bolts 20. The outer end of each rod has an offset or laterally extending portion such as leg 28 and, of course, the pockets 29 should be large enough and long enough in a direction parallel to the surface of the wall to enable turning the rods 27 to thread them into the nuts 12. Then with the legs 28 in the downward direction, concrete or other settable material 29 is poured into the pockets and allowed to set. Once this is accomplished, the wall is securely anchored. Then the anchor blocks 29 are covered with dirt or other backfill material, following which the trenches 23 are filled, and finally this is followed by backfilling the excavation at 24. As suggested above, it is possible for the builder to frame or erect the superstructure on the wall before backfilling, if desired. In any case, however, it is desirable to fill at least the portion of the pockets 26 over the blocks 29 and also to fill the trenches 23.

As indicated above, it is possible to install the plates 14 on the outer form 19 before erecting that form. Also it is possible to make a complete assembly of the plates, outer and inner forms before the forms are erected. The selection of the exact sequence of steps will depend largely on preferences of the builder and his convenience. The material used in the form can be any of the conventional materials used for such purposes. If for some reason it would be thought necessary to use for the outer form a material not readily penetrable by nails 17, screws and nuts could be used in place of the nails.

An an example, and not by way of limitation, the plates are preferably 12 inches square and the holes 18 are typically 3/16 inch diameter. A ⅝–13 thread on the nut 12 is useful and the plate thickness may be 3/16 inch. The rod may be of ⅝ inch diameter hot rolled steel having an overall length of eight feet from the inner end which is threaded, to the outer end where the offset is located, and the length of the offset may be one foot.

While the invention has been disclosed and described in some detail in the drawings and foregoing description, they are to be considered as illustrative and not restrictive in character, as other modifications may readily suggest themselves to persons skilled in this art and within the broad scope of the invention. One such modification is use of tube 13 to space the inner plates from the inner form, and nail the plates to the inner form instead of the outer form.

The invention claimed is:

1. Wall bracing apparatus for use in the ground comprising:

a plate having first fastener means affixed thereto;

an elongated member extending generally perpendicular to the plane of the plate and having second fastener means at one end thereof cooperating with said first fastener means to secure said plate and said member together, and said member having lateral offset means at the other end thereof for anchorage;

first spacer means affixed to the plate and extending from the plate toward the offset means and surrounding a portion of the member from said plate to the end of the spacer remote from the plate whereby said spacer means serves as a first shield; and a solidified mass disposed in the ground remote from said plate and affixed to a portion of said offset means, and anchoring said member in the ground.

2. The apparatus of claim 1 and further comprising:

a wall having said plate embedded therein.

3. The apparatus of claim 2 wherein:

the location of said plate between inside and outside faces of said wall is such that an end of said first spacer means is flush with the outside face of said wall, and an end of said second spacer means is spaced from the inside face of said wall.

4. The apparatus of claim 2 and further comprising:

a plurality of plates at horizontally spaced locations in said wall;

a plurality of elongated members, each having an end portion secured in one of said plates, and each projecting from said wall generally perpendicular to said wall, and each having laterally extending means at the end thereof remote from the wall; and a plurality of masses anchored in the ground at points horizontally spaced from said wall and from each other, each of said masses being affixed to the said laterally extending means of at least one of said elongated members.

* * * * *